US012742366B2

(12) United States Patent
Mair

(10) Patent No.: US 12,742,366 B2
(45) Date of Patent: Sep. 22, 2026

(54) NON-DESTRUCTIVELY DECOUPLING ELECTRIC ACTUATOR OF DOWNHOLE FLOW CONTROL DEVICE

(71) Applicant: Halliburton Energy Services, Inc., Houston, TX (US)

(72) Inventor: Ryan David Mair, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/948,760

(22) Filed: Nov. 15, 2024

(65) Prior Publication Data

US 2026/0139567 A1 May 21, 2026

(51) Int. Cl.
*E21B 34/06* (2006.01)
*E21B 34/14* (2006.01)

(52) U.S. Cl.
CPC ..... *E21B 34/066* (2013.01); *E21B 34/14* (2013.01)

(58) Field of Classification Search
CPC ..... E21B 34/066; E21B 34/14
See application file for complete search history.

(56) References Cited

U.S. PATENT DOCUMENTS 5,906,238 A 5/1999 Carmody et al.
6,041,857 A 3/2000 Carmody et al.
10,280,715 B2 5/2019 Macleod et al.
2001/0054505 A1* 12/2001 Carmody ..... E21B 21/10 166/250.15
2011/0147013 A1* 6/2011 Kilgore ..... E21B 33/1285 166/387
2012/0067583 A1 3/2012 Zimmerman et al.
2013/0213673 A1 8/2013 Crabb et al.
2015/0308206 A1* 10/2015 Yue ..... E21B 34/103 166/387

FOREIGN PATENT DOCUMENTS

EP 3505721 B1 5/2021
WO 2024076734 A1 4/2024

OTHER PUBLICATIONS

PCT/US2024/058660, "International Search Report and Written Opinion", Aug. 8, 2025, 13 pages.

* cited by examiner

*Primary Examiner* — Giovanna Wright
(74) *Attorney, Agent, or Firm* — Kilpatrick Townsend & Stockton LLP

(57) ABSTRACT

A flow control device such as an inflow control valve is disclosed. The flow control device can include an override assembly for non-destructively decoupling an actuator from a flow control component of the flow control device. The flow control device may include an override assembly having a floating shifting member that is arranged within the flow control component, and is linearly displaceable relative to a device body of the flow control device and limitedly linearly displaceable relative to the flow control component. The floating shifting member is linearly displaceable by a shifting tool from a first position where the floating shifting member supports a coupled arrangement of the flow control component and the actuator assembly to a second position where the coupled arrangement of the flow control component and the actuator assembly is unsupported by the floating shifting member and the flow control component is decouplable from the actuator assembly.

20 Claims, 10 Drawing Sheets

NON-DESTRUCTIVELY DECOUPLING ELECTRIC ACTUATOR OF DOWNHOLE FLOW CONTROL DEVICE

TECHNICAL FIELD

The present disclosure relates generally to hydrocarbon well operations, and more particularly although not necessarily exclusively, to overriding an actuator of a downhole flow control device by non-destructively decoupling the linear actuator from a movable flow control component of the flow control device.

BACKGROUND

In hydrocarbon well operations, completion operations may follow the drilling of a wellbore. The completion operations may include placing various completion equipment downhole in the wellbore. This equipment may include, for example, casing, tubing, and well interval isolation devices. It is also typical to include amongst the completion equipment, one or more flow control devices for controlling, for example, a flow of hydrocarbons into the wellbore (e.g., into the completion tubing). A flow control device may be a controllable valve, such as an inflow control valve. The valve may include an actuator that operates to open or close one or more fluid ports through which hydrocarbons can flow. Such valves occasionally malfunction. For example, a valve actuator may stop working or an accumulation of debris in the area of the valve may prohibit the actuator from activating the valve between an open and close position. In such a case, it is common practice to insert a shifting tool into the wellbore and to use the shifting tool to physically displace the flow control element in an uphole or downhole direction to open or close the fluid ports of the valve. In some cases, the shifting tool may need to be deployed to a downhole depth of several thousand meters, and the shifting tool may need to apply a significant displacement force to move the flow control element. Use of such a shifting tool is also commonly destructive with respect to the valve. More specifically, use of such a shifting tool typically breaks a coupling between the flow control element and the actuator, which renders the actuator incapable of subsequently operating the valve.

DETAILED DESCRIPTION

Figure 1:
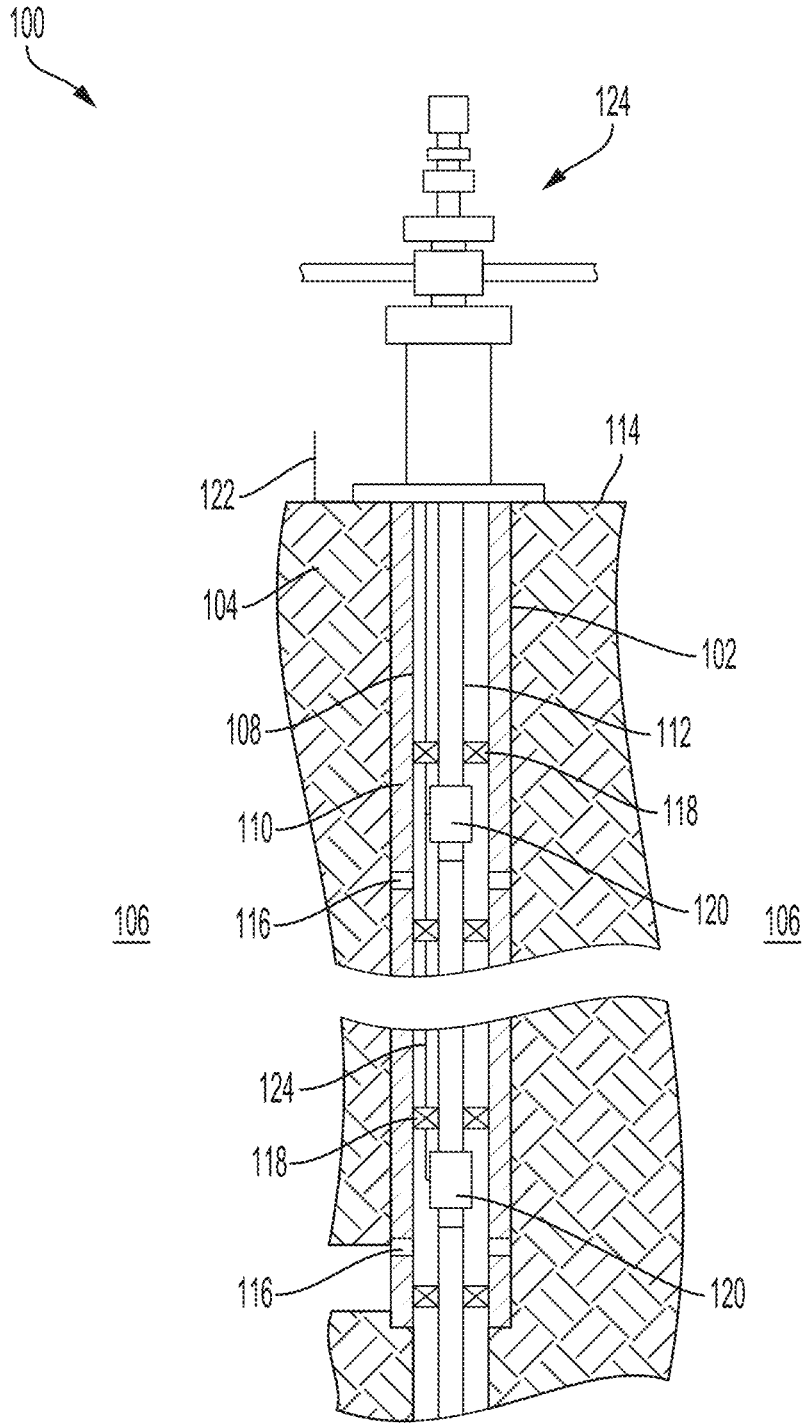
FIG. 1 depicts a schematic diagram of a completed hydrocarbon wellbore, according to one example.

Certain aspects and examples of the present disclosure relate to a flow control device, such as an inflow control valve (ICV) usable to control a flow of hydrocarbons into a completed wellbore, and to an override assembly for non-destructively decoupling an actuator (e.g., an electronic actuator) from a flow control component of the flow control device. Decoupling the actuator from the flow control component of the flow control device can facilitate manual operation of the flow control device using a shifting tool that can be deployed from a well surface to a downhole location of the flow control device. The shifting tool may be deployed and used in the event of, for example, an actuator malfunction or the presence of an obstruction that prevents movement of the flow control element by the actuator. With the actuator decoupled from the flow control element, the shifting tool can be used to manually displace the flow control component without resistance from the actuator. By decoupling the actuator from the flow control element in a manner that is non-destructive to the actuator and to a connection between the actuator and the flow control component, it may be possible after using the shifting tool, to recouple the actuator to the flow control component and to resume normal control and operation of the flow control device.

In some examples, the flow control component may be a tubular member such as a sleeve mandrel that can be concentrically arranged and linearly slidable within a device body of the flow control device to control a fluid flow into (or out of) the flow control device. In some examples, an actuator assembly may reside within a cavity in a device body of the flow control device and may include, for example, an drive motor coupled to a threaded linear displacement element, and an actuator coupling element in threaded engagement with the linear displacement element. The linear displacement element may be, for example, a lead screw or a ball screw and the actuator coupling element may be linearly displaceable relative to the device body by operating the drive motor. The flow control component may be releasably coupled to the actuator coupling element such that the flow control component can be linearly displaced by movement of the actuator coupling element.

The flow control device may further include an override assembly. In some examples, the override assembly may include a floating shifting member. The floating shifting member may also be a tubular member and can be concentrically arranged within the flow control component. The floating shifting member may be engageable and linearly displaceable by the flow control component and also by a downhole deployable shifting tool. The override assembly may further include a flow control component coupling element that resides between the actuator assembly and the floating shifting member and is releasably engageable with the actuator coupling element to releasably couple the actuator assembly to the flow control component.

The flow control component is linearly displaceable relative to the device body of the flow control device. The floating shifting member is also linearly displaceable relative to the device body and can be additionally limitedly linearly displaceable relative to the flow control component. After engagement by the shifting tool, such as when there is a problem with the actuator assembly, the floating shifting member can be displaced by the shifting tool from a first position where the floating shifting member supports coupling of the flow control component coupling element and the actuator coupling element of the actuator assembly, to a second position where the flow control component coupling element is unsupported by the floating shifting member and the flow control component coupling element and the actuator coupling element are thereby decoupled. Decoupling the flow control component coupling element and the actuator coupling element decouples the flow control component from the actuator assembly and thereby allows the flow control component to be freely moved by the shifting tool via movement of the floating shifting member.

In some examples, the floating shifting member may include a shifting tool engagement profile on an inner wall surface thereof to facilitate engagement of the shifting tool. In some examples, the floating shifting member may include an actuator coupling-decoupling profile on an outer wall surface thereof. The actuator coupling-decoupling profile may include, for example, a flow control component coupling element support projection that can support or encourage engagement of the flow control component coupling element with the actuator coupling element when the floating shifting member and the flow control component are positioned relative to one another such that the flow control component coupling element support projection underlies the flow control component coupling element.

In some examples, the floating shifting member may be releasably coupled to and may be caused to be linearly displaced by a linear displacement of the flow control component by the friction of at least one seal that is interposed between the floating shifting member and the flow control component. In some examples, the override assembly may further include a releasable latching mechanism to further releasably couple the flow control component to the floating shifting member.

Illustrative examples follow and are given to introduce the reader to the general subject matter discussed herein rather than to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 schematically illustrates one example of a completed hydrocarbon well 100. As shown in FIG. 1, this example of the hydrocarbon well 100 is a production well, but the hydrocarbon well 100 could instead be a hydrocarbon injection well in other examples. The hydrocarbon well 100 includes a wellbore 102 that is drilled in a subterranean formation 104 within a reservoir 106, but may alternatively be drilled in a sub-oceanic formation in other examples. In this example, the hydrocarbon well 100 includes only a vertical wellbore 102. In other examples, the hydrocarbon well 100 may also have a horizontal wellbore portion. The hydrocarbon well 100 may include a wellbore casing 108, which may be cemented into the wellbore 102 by introducing cement 110 into an annular space between the wellbore 102 and the wellbore casing 108.

The hydrocarbon well 100 may include a tubing-conveyed completion. The tubing-conveyed completion may include a tubing string 112, such as a coiled tubing string. The tubing string 112 may extend from within the wellbore 102 to or above the ground surface 114 around the hydrocarbon well 100. The tubing of the tubing string 112 provides a conduit via which hydrocarbons from the formation 106 can be transported to the well surface 114. In some examples, the completion may be an intelligent completion, which may also include sensors or other devices that can facilitate monitoring and control over the hydrocarbon well 100.

The hydrocarbon well 100 may also include multiple sets of perforation clusters 116 that are disposed at intervals along the wellbore 102 and pass through the wellbore casing 108 and the cement 110. The locations of the different sets of the perforation 116 clusters may coincide with different producing intervals of the hydrocarbon well 100, which can occur at different depths of the wellbore 102. The perforation clusters 116 allow hydrocarbons from the formation 106 to be admitted into the wellbore 102. In other examples, the perforation clusters 116 can also allow pressurized fluids to be pumped downhole and injected into the formation 106 through the perforation clusters 116.

In this example of the hydrocarbon well 100, the perforation clusters 116 may be isolated using isolation elements 118 such as plugs, inflatable packers or the like. In the example depicted in FIG. 1, multiple isolation elements 118 are arranged along the length of the tubing string 112 to straddle the various perforation clusters 116, as shown. The isolation elements 118 may thus be deployed in pairs, where a first isolation element 118 is positioned on the uphole side and a cooperating isolation element 118 is positioned on the downhole side, of each set of the perforation clusters 116 in the wellbore 102.

The inflow of hydrocarbons into the tubing string 112 (or the outflow of pressurized injection fluid 114 from the hydrocarbon well 100 into the formation 106) can be controlled by flow control devices such as valves. For example, an inflow of hydrocarbons from the formation 106 into the tubing string 112 can be controlled using inflow control valves (ICVs) 120 installed downhole in the hydrocarbon well 100. The ICVs 120 may be electronic valves. The ICVs 120 may be installed into the tubing string 112 at various intervals. The ICVs can be arranged along the length of the tubing string 112 such that each ICV 120 is located in the vicinity of a perforation cluster 116 and within a corresponding isolation zone defined by cooperating pairs of the isolation elements 118. In this example, the ICVs 120 are powered and controlled (e.g., opened, closed, adjusted) from the well surface 114 by way of one or more cables 122 that extend from the well surface 114 into the wellbore 102. In other examples, the ICVs 120 can include an onboard power supply such as, for example, a battery or a capacitor. Other ICV control scenarios are possible in other examples, some of which are described in more detail below. At the well surface 114, the completion of the hydrocarbon well 100 may include a wellhead 124 (e.g., Christmas tree) or another well completion apparatus such as a pump, a derrick, etc.

Downhole flow control devices, such as the ICVs 120 of FIG. 1 or other flow control valves, can malfunction. For example, as described above, an actuator of a flow control valve may stop working or debris may accumulate within a wellbore in the area of a valve to an extent that the valve actuator is not strong enough to move a flow control element of the valve against the weight of the debris. In either case, subsequent changes in the valve operating mode (e.g., opened to closed or vice versa) and subsequent valve setting adjustments (e.g., flow rate adjustments) by the valve actuator will no longer be possible. This can present significant problems for the well operator, as the location of the malfunctioning or inhibited flow control valve within the wellbore may be several thousand meters below ground A commonly employed solution to such flow control device problems is to deploy a shifting tool into the wellbore, engage the flow control element with the shifting tool, and use the shifting tool to physically displace the flow control element in an uphole or downhole direction as needed to open, close, or adjust a flow rate of the flow control valve. Use of such a shifting tool can also be problematic. For example, the shifting tool may need to be deployed to and operated at potentially significant downhole depths. Additionally, in either of the valve failure case examples presented above, the actuator remains physically connected to the flow control element. As a result, use of the shifting tool is often destructive to the valve because enough force must be applied to the flow control element by the shifting tool to either overcome the inherent resistance to movement of the actuator or to physically break the connection between the actuator and the flow control element. Since the average connection between the actuator and the flow control element of a flow control valve will typically break under less force than will be required to overcome the resistance to movement of the actuator, a breaking of the connection between the actuator and the flow control element is a usual result of using a shifting tool. As previously mentioned, even if a malfunctioning actuator can thereafter be repaired or if debris preventing proper operation of the actuator can be cleared, further operation and control of the valve by the actuator is rendered impossible once the connection between the actuator and the flow control element is broken. Instead, valve operating modes and flow rate adjustments will need to be made by manipulating the position of the flow control element using the shifting tool.

Figure 2:
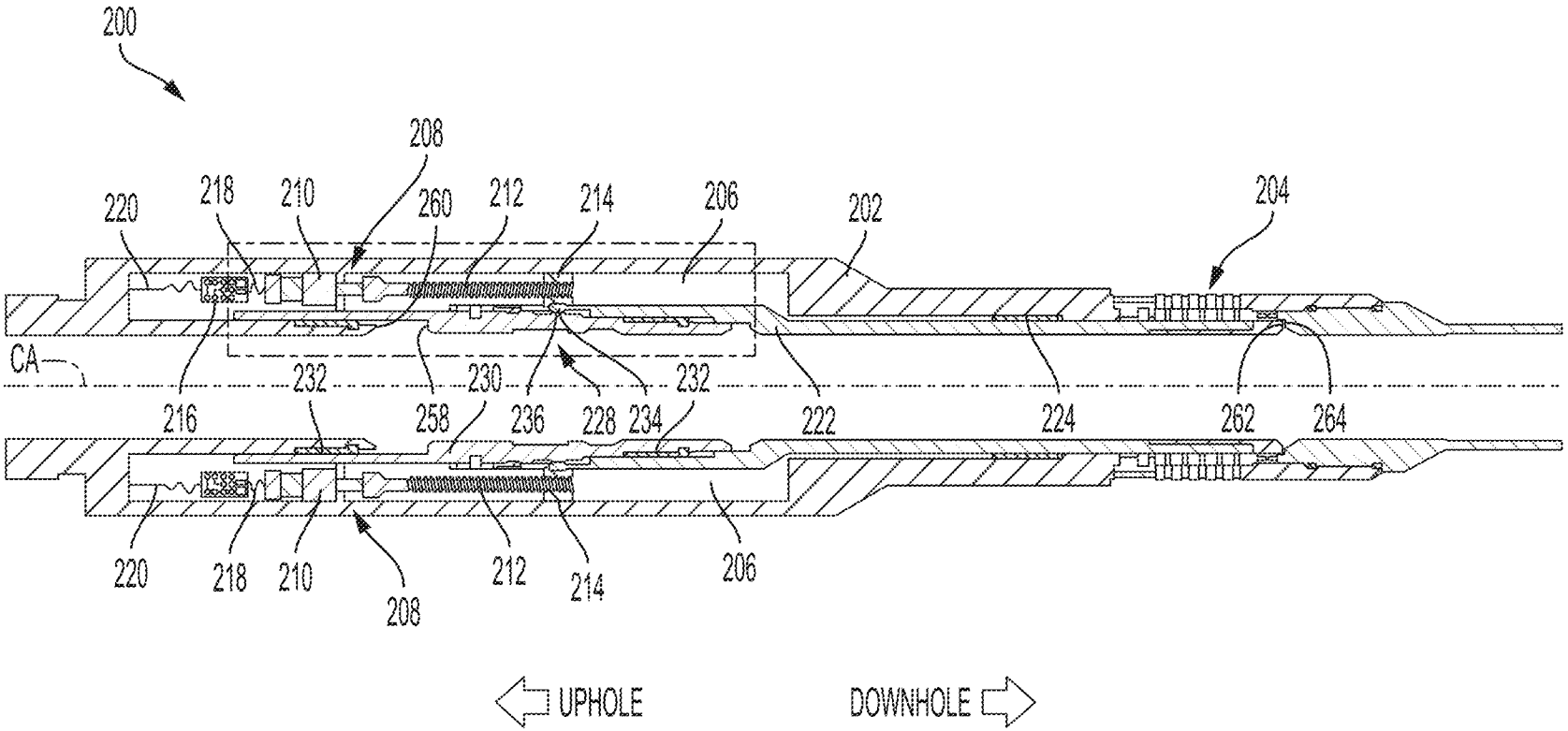
FIG. 2 depicts a cross-sectional side view of a flow control device configured as an inflow control valve for controlling a downhole flow of hydrocarbons into completion tubing deployed in a wellbore and including an override assembly, according to one example.

FIG. 2 presents a cross-sectional side view of a flow control device 200 configured as an electronic inflow control valve (ICV) that is deployable downhole in a wellbore. The ICV 200 may correspond to, for example, the ICV 120 of the hydrocarbon well 100 illustrated in FIG. 1 to control a downhole flow of hydrocarbons into the tubing string 112 located in the wellbore 102.

The ICV 200 may include a device body 202. The device body 202 may be a substantially hollow tubular member having a central axis of rotation CA. The device body may include one or more ports 204 that pass through a wall of the device body 202. Fluids, such as well fluids (e.g., hydrocarbons) may be admitted into the device body 202 through the ports 204.

As shown, the device body 202 may include a cavity 206 or recess within which may be located an actuator assembly 208. In this example, the actuator assembly includes a pair of actuators 226, which may be linear actuators. The actuators 226 may be electric actuators, such as electric linear actuators. In other examples, the actuators 226 may be hydraulic actuators, such as linear hydraulic actuators. In this example, each actuator 226 includes a drive motor 210 that is coupled to and rotates a displacement element in the form of a lead screw/ball screw 212. The drive motor 210 may be an electric drive motor. An actuator coupling element 214, such as a linearly displaceable nut (described in more detail below), is in threaded engagement with the lead screw/ball screw 212. The actuator coupling element 214 is rotationally constrained but linearly displaceable within the cavity 206, and the drive motor 210 is constrained from both rotation and linear displacement. As such, operation of the drive motor 210 will cause a rotation of the lead screw/ball screw 212 in a selected direction, resulting in the linear displacement of the actuator coupling element 214 in a desired first (uphole) or second (downhole) direction within the cavity 206 and relative to the device body 202.

Control hardware may also be located in the cavity 206 in some examples. For example, a printed circuit board 216 or one or more other logic/processor components may be located in the cavity and communicatively coupled, by wiring 218 to the drive motor 210 for controlling operation of the drive motor 210. The printed circuit board 216 may, in some examples, also be connected to one or more sensors, such as an encoder or other types of position sensors (not shown) to determine the location of the actuator coupling element 214 or for other reasons. In the example of FIG. 2, an additional wire/cable 220 for transmitting data and/or power to the printed circuit board 216 is communicatively coupled thereto. The wire/cable 220 may also transmit power to the drive motor 210. In some examples, the wire/cable 220 may additionally be usable to transmit data from the circuit board 216, such as position data associated with the actuator coupling element 214 or diagnostic data associated with the drive motor 210, etc. The wire/cable 220 may extend from equipment located at a surface of a hydrocarbon well in which the ICV 200 is deployed.

The ICV 200 example of FIG. 2 may also include a flow control component, which is shown in FIG. 2 as a slidable sleeve mandrel 222 (hereinafter "mandrel" for brevity). Like the device body 202, the mandrel 222 may also be a substantially hollow tubular member. The mandrel 222 may be concentrically arranged within the device body 202 and may share the central axis of rotation CA with the device body 202. In some examples, at least a portion of an outer wall surface of the mandrel 222 may be in abutting but slidable contact with an inner wall surface of the device body 202. In the case of the ICV 200 shown in FIG. 2, seals 224 are interposed between the outer wall surface of the mandrel 222 and the inner wall surface of the device body 202. The seals 224 can, among other functions, help to prevent fluid passing through the ICV 200 from entering the cavities 206 in the device body 202 through any gaps therebetween.

In the ICV 200, the mandrel 222 is linearly displaceable relative to the device body 202 and along a path that is generally parallel to the central axis CA. As described in more detail below, the actuator coupling element 214 of the actuator assembly 208 may be releasably coupled to the mandrel 222. Consequently, actuating the drive motor 210 to linearly displace the actuator coupling element 214 in one direction or the other will cause a linear displacement of the mandrel 222 within the device body 202 and in the same direction as the actuator coupling element 214.

Linear displacement of the mandrel 222 within the device body 202 can be used to control fluid flow through the ports 204 in the device body. For example, when it is desired to permit fluid passage through the ICV 200, the mandrel 222 may be linearly displaced by the actuator assemblies 208 to a (uphole in this case) position where the wall of the mandrel is clear of the ports 204 and the fluid ports 204 are thus open. When it is desired to prevent fluid passage through the ICV 200, the mandrel 222 may be linearly displaced by the actuator assemblies 208 to a position where the mandrel wall blocks the fluid ports 204 and the fluid ports 204 are thus closed. The mandrel 222 may also be linearly displaced by the actuator assemblies 208 to a position where only a portion of the fluid ports 204 are blocked by the wall of the mandrel, which can allow fluid flow through the ICV 200 to be choked.

As further illustrated in FIG. 2, and as described in more detail below, this example of the ICV 200 further includes an override assembly 228 that is usable, according to aspects of the disclosure, to non-destructively decouple the actuator assemblies 208 from the mandrel 222. As described in more detail below with respect to FIGS. 3-8, the override assembly 228 can comprise, among other things, a floating shifting member 230, including a flow control component coupling element (e.g., collet) support projection 236 and an unlatching projection 256 thereof, a mandrel coupling element 234, and a latching mechanism 238. Like the device body 202 and the mandrel 222, the floating shifting member 230 may also be a substantially hollow tubular member and may be concentrically arranged within the mandrel 222 such that the floating shifting member 230, the mandrel 222, and the device body 202 all share the central axis of rotation CA. The floating shifting member 230 may be linearly displaceable relative to the device body 202 and also limitedly linearly displaceable relative to the mandrel 222. A sufficient linear displacement of the floating shifting member 230 will cause a linear displacement of the mandrel 222 in a like direction.

In this example, a distance by which the floating shifting member 230 can be linearly displaced in an uphole direction is limited by contact of a stop face 258 on a first end (e.g., an uphole end) of the floating shifting member 230 with a stop face 260 on an end of the device body 202. This also serves as a limit on the distance by which the mandrel 222 can be linearly displaced in an uphole direction. The distance by which the mandrel 222 can be linearly displaced in a downhole direction is similarly limited by contact of a stop face 262 on a downhole end of the mandrel 222 with another stop face 264 on the device body 202.

In some examples, at least a portion of an outer wall surface of the floating shifting member 230 may be in abutting but slidable contact with an inner wall surface of the mandrel 222. In the case of the ICV 200 shown in FIG. 2, seals 232 may be interposed between the outer wall surface of the floating shifting member 230 and the inner wall surface of the mandrel 222. The seals 232 can, among other functions, help to prevent fluid passing through the ICV 200 from entering the cavities 206 in the device body 202 through any gaps between the floating shifting member 230 and the mandrel 222.

The floating shifting member 230 may be designed and arranged to, in cooperation with other components of the override assembly 228 described in more detail below, selectively decouple the actuator coupling element 214 from the mandrel 222. When so decoupled, the mandrel 222 may be linearly displaced relative to the device body 202 without the resistance that would otherwise result from attempting to forcibly displace the actuator coupling element 214 and back-driving the drive motor 210.

The floating shifting member 230 may also be configured to engage with an external shifting tool 254 (see FIGS. 5-6) that can be deployed into a well in which the ICV 200 is located. More specifically, the shifting tool 254 can be used to decouple the actuator coupling element 214 from the mandrel 222 by applying a sufficient displacement force to the floating shifting member 230 in a first (uphole) or second (downhole) direction. In such a case, the floating shifting member 230 may be linearly displaced from a first position where the floating shifting member 230 supports engagement of the mandrel 222 to the actuator coupling element 214 of the actuator assemblies 208, to a second position where the actuator coupling element 214 (and thus the drive motor 210 and the lead screw/ball screw 212) of the actuator assembly 208 becomes decoupled from the mandrel 222.

Figure 3:
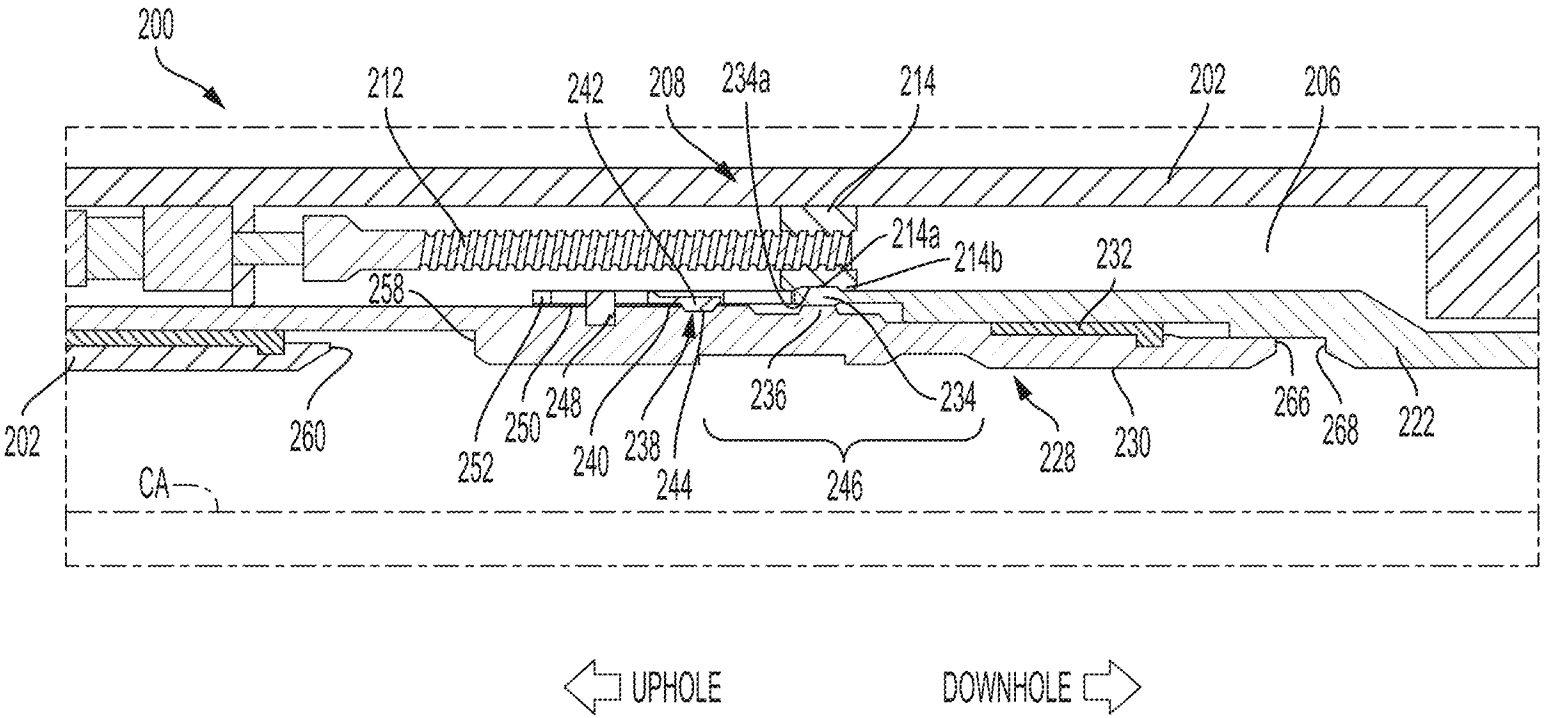
FIG. 3 depicts an enlarged cross-sectional view of a portion of the inflow control valve of FIG. 2, wherein an actuator assembly and components of an override assembly of the inflow control valve are shown in more detail.

FIG. 3 presents an enlarged cross-sectional view of a portion of the ICV 200 of FIG. 2, wherein various components of the actuator assembly 208 and the override assembly 228 of the ICV 200 are shown in greater detail. For example, it may be observed that the actuator coupling element 214 of the actuator assembly 208 can be releasably coupled to the mandrel 222 by way of a mandrel coupling element 234 of the override assembly 228. In this example, the mandrel coupling element 234 is shown as a mandrel coupling collet 234 that encircles the mandrel 222. The mandrel coupling collet 234 may be a flexible member (e.g., finger) that is located on or is integral to the mandrel 222 and can be deflected in a radially outward or radially inward direction to respectively engage with or disengage from the actuator coupling element 214. In other examples, the mandrel coupling element 234 may instead be another element(s) that can releasably couple the mandrel 222 to the actuator coupling element 214, For example, instead of a collet, the mandrel coupling element 234 may be a key(s) that falls into a recess, a detent, canted springs, a magnetic catch, or another coupling element(s).

With the mandrel 222 and the floating shifting member 230 positioned relative to one another as shown in FIG. 3, the actuator coupling element 214 can engage the mandrel coupling collet 234 and be supported in an engaged position by a collet support projection 236 that may be a component of an actuator coupling-decoupling profile located on an outer wall surface of the floating shifting member 230. The collet support projection 236 may extend radially outwardly from the floating shifting member 230 and is arranged to underly the mandrel coupling collet 234 when the mandrel 222 and the floating shifting member 230 are in the relative positions shown in FIG. 3. In this position, the mandrel coupling collet 234 is thus prevented by the collet support projection 236 from deflecting inward toward the central axis CA and resultantly disengaging from the actuator coupling element 214

In this example, releasable engagement of the mandrel coupling collet 234 and the actuator coupling element 214 may be facilitated by seating a protruding engagement surface 234*a* of the mandrel coupling collet 234 in a retention recess 214*a* of the actuator coupling element 214. The protruding engagement surface 234*a* of the mandrel coupling collet 234 and the retention recess 214*a* in the actuator coupling element 214 may have cooperating shapes for this purpose. Retention of the mandrel coupling collet 234 by the actuator coupling element 214 due to an inherent deflection force of the mandrel coupling collet 234 may alone be sufficient to cause the mandrel 222 to move with the actuator coupling element 214 (see, e.g., FIG. 7). The floating shifting member 230 can be used to better ensure that the actuator coupling element 214 is sufficiently engaged with the mandrel coupling collet 234 to cause movement of the mandrel 222. For example, the floating shifting member 230 may be positioned relative to the mandrel 222 such that the collet support projection 236 of the floating shifting member 230 underlies the mandrel coupling collet 234 and supports its engagement with the actuator coupling element 214, as shown.

With the actuator coupling element 214 of the actuator assembly 208 coupled to the mandrel 222 by way of the mandrel coupling collet 234 as described above, the drive motor 210 can be operated to linearly displace the mandrel 222. For example, actuation of the drive motor 210 in a selected direction will rotate the lead screw/ball screw 212 to thereby linearly displacing the actuator coupling element 214 in a desired direction. As the actuator coupling element 214 is coupled to the mandrel 222 by way of the mandrel coupling collet 234, this will cause a like linear displacement of the mandrel 222. Additionally, due at least to frictional forces exerted on both the mandrel 222 and the floating shifting member 230 by the seal 232 interposed therebetween, the linear displacement of the mandrel 222 will cause a like linear displacement of the floating shifting member 230.

In this example, the override assembly 228 may also include an optional releasable latching mechanism 238. The releasable latching mechanism 238 may be provided to further ensure mutual linear displacement of the mandrel 222 and the floating shifting member 230 upon linear displacement of the mandrel 222 by the electric actuator assembly 208. In this example, the releasable latching mechanism 238 may include a flexible latching member 240 associated with the mandrel 222. The flexible latching member 240 may include a protruding engagement portion 242. The protruding engagement portion 242 may extend into a cooperating latching groove 244 located in the outer wall surface of the floating shifting member 230 when the mandrel 222 and the floating shifting member 230 are in the relative positions shown in FIG. 3. In other examples, the flexible latching member 240 may be associated with the floating shifting member 230 instead of the mandrel 222 and the cooperating latching groove 244 may be located in the mandrel 222 instead of the floating shifting member 230. In any case, the releasable latching mechanism 238 can at least help to maintain the mutually linearly displaceable relationship between the mandrel 222 and the floating shifting member 230 by providing a limited and overridable amount of releasable engagement therebetween. As described below, the releasable latching mechanism 238 can be unlatched by a deliberate displacement of the floating shifting member 230 relative to the mandrel 222.

In other examples, the releasable latching mechanism 238 and the functionality thereof may be replaced with other releasable component engagement arrangements. For example, the releasable latching mechanism 238 may be replaced with a displaceable key, a magnetic connection, a seal, or with other components that can provide temporary interference or frictional resistance to movement of the floating shifting member 230 relative to the mandrel 222.

As previously described, in a case where one or more components (e.g., the drive motor 210) of the actuator assembly 208 of a deployed ICV 200 fails, the mandrel 222 can be manually moved to a desired position relative to the device body 202 of the ICV 200 by using the shifting tool 254 to engage and displace the floating shifting member 230. For this purpose, at least a portion of the inner wall surface of the floating shifting member 230 may include a shifting tool engagement profile 246 that mimics an external shape of a portion of the shifting tool and facilitates engagement of the floating shifting member 230 by the shifting tool.

A significant linear displacement force may need to be applied to the floating shifting member 230 by the shifting tool 254 to cause a desired manual linear displacement of the mandrel 222. Consequently, it is possible that neither the frictional coupling of the mandrel 222 to the floating shifting member 230, nor the additional coupling force imparted by the flexible latching mechanism 238, will be sufficient to cause the mandrel 222 to move with the floating shifting member 230 when the floating shifting member 230 is linearly displaced by the shifting tool 254. As such, the override assembly 228 may further include a stop element 248 that can extend radially outward from the outer wall surface of the floating shifting member 230. In some examples, the stop element 248 can be one or more stop pins or keys, a protruding ring, etc. A portion of the stop element 248 may travel in a receiving slot 250 in the mandrel 222 when the floating shifting member 230 is linearly displaced relative to the mandrel 222. An end wall of the receiving slot 250 may act as a hard stop 252 against travel by the stop element. The distance by which the floating shifting member 230 can be linearly displaced in an uphole direction relative to the mandrel 222 is limited by contact of the stop element 248 with the hard stop 252. Thus, once the shifting tool linearly displaces the floating shifting member 230 relative to the mandrel 222 to a point where the stop element 248 contacts the hard stop 252, a continued displacement of the floating shifting member 230 will cause a like linear displacement of the mandrel 222. While the stop element 248 is associated with the floating shifting member 230 and the receiving slot 250 and the hard stop 252 are associated with the mandrel 222 in this example, other examples may utilize a reverse arrangement where the stop element 248 extends from the mandrel 222 into a receiving slot 250 in the floating shifting member 230. In this example, distance by which the floating shifting member 230 can be linearly displaced in a downhole direction relative to the mandrel 222 is also limited by contact of a stop face 266 on a second end (e.g., downhole end) of the floating shifting member 230 with a stop face 268 on the mandrel 222.

Figure 4:
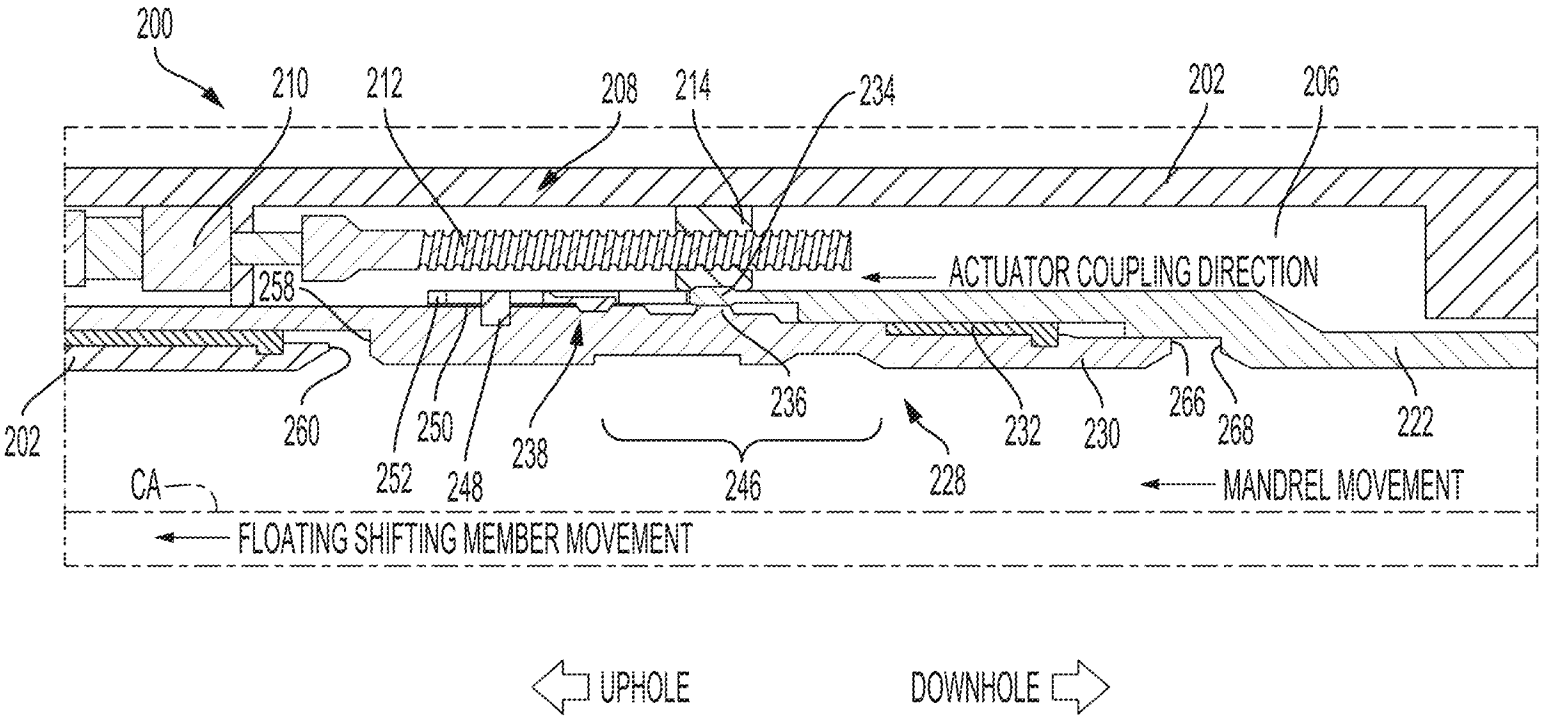
FIG. 4 depicts the enlarged cross-sectional view of FIG. 3, but with a flow control component and various components of the override assembly displaced as a result of operation of the actuator assembly.

FIG. 4 depicts the portion of the ICV 200 shown in FIG. 3, but with the mandrel 222, the actuator coupling element 214, and the floating shifting member 230 of the ICV 200 linearly displaced in an indicated uphole direction as a result of rotating the lead screw/ball screw 212 by operation of the drive motor 210. As shown, and as previously described, the linear displacement of the mandrel 222 is directly caused by linearly displacing the actuator coupling element 214 by rotating the lead screw/ball screw 212 by operation of the drive motor 210. A like linear displacement of the floating shifting member 230 is a result of the floating shifting member 230 being coupled to the mandrel 222 by the friction imparted by the seal 232 and/or engagement of the releasable latching mechanism 238.

Figure 5:
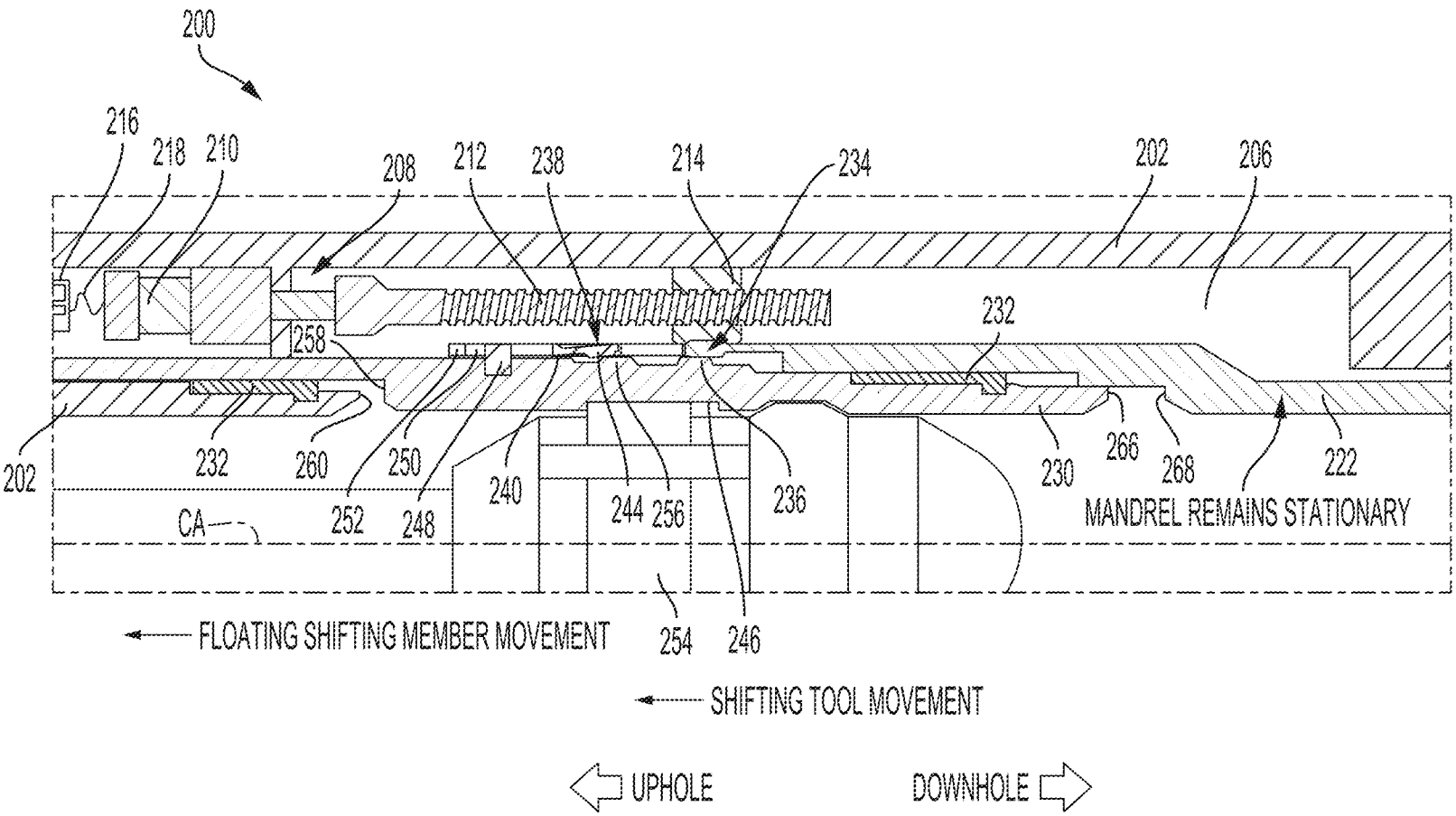
FIG. 5 depicts the enlarged cross-sectional view of FIG. 4, but with a shifting tool engaged with a component of the override assembly and various components of the override assembly further displaced as a result of a decoupling movement of the shifting tool.

FIG. 5 depicts the portion of the ICV 200 shown in FIG. 4, but with a portion of a shifting tool 254 engaged with the engagement profile 246 of the floating shifting member 230. As shown, a subsequent uphole movement of the shifting tool 254 by associated equipment located at the well surface has applied a displacement force to the floating shifting member 230 sufficient to further linearly displace the floating shifting member 230 in the indicated uphole direction relative to the mandrel 222. Consequently, the collet support projection 236 of the floating shifting member 230 is linearly displaced relative to the mandrel coupling collet 234 of the mandrel 222 and to the actuator coupling element 214 of the electric actuator assembly 208.

The releasable latching mechanism 238 may also be unlatched by the further linear displacement of the floating shifting member 230. The floating shifting member 230 may include an unlatching projection 256 for this purpose. In this example, the unlatching projection 256 is another component of the actuator coupling-decoupling profile of the floating shifting member 230, but may instead be a component of the mandrel 222 in examples where the flexible latching member 240 is associated with the mandrel 222 rather than the floating shifting member 230. In this example, the unlatching projection 256 may extend radially outwardly from the floating shifting member 230 in a like manner to the collet support projection 236. As may be observed, contact of the unlatching projection 256 with the flexible latching member 240 can cause an unlatching of the releasable latching mechanism 238 by disengaging the protruding engagement portion 242 of the flexible latching member 240 from the cooperating latching groove 244 in the floating shifting member 230. The unlatching projection 256 may have a sloped leading edge to facilitate the unlatching movement of the flexible latching member 240. Thus, it may be understood from FIG. 5, that the uphole movement of the shifting tool 254 while the shifting tool 254 is engaged with the floating shifting member 230 will overcome the friction of the seals 232 and the engagement force of the releasable latching mechanism 238, and begins the process of decoupling the actuator assembly 208 from the mandrel 222.

Figure 6:
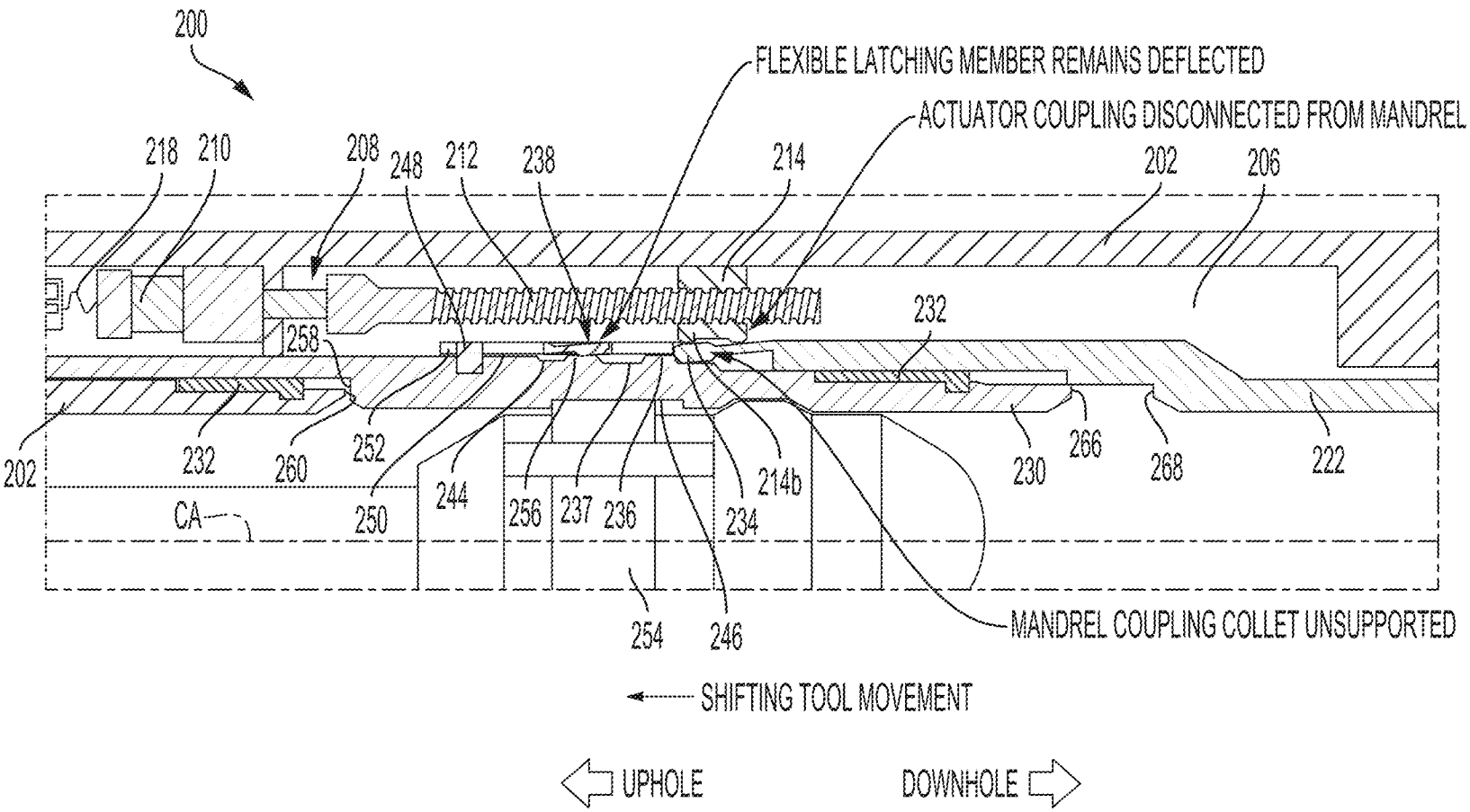
FIG. 6 depicts the enlarged cross-sectional view of FIG. 5, but with various components of the override assembly further displaced and the actuator assembly decoupled from the flow control component as a result of a further decoupling movement of the shifting tool.

FIG. 6 depicts the portion of the ICV 200 shown in FIG. 5, but with the floating shifting member 230 further linearly displaced in an uphole direction relative to the mandrel 222 as result of a further decoupling (uphole) movement of the shifting tool 254. As shown, the collet support projection 236 no longer underlies the mandrel coupling collet 234 and the retention recess 214*a* in the actuator coupling element 214 is no longer aligned with nor retains the protruding engagement surface 234*a* of the mandrel coupling collet 234. The mandrel coupling collet 234 may also be deflected inward toward the central axis CA by contact between an inwardly projecting lobe 214*b* of the actuator coupling element 214 and the protruding engagement surface 234*a* of the mandrel coupling collet 234. The mandrel 222 is thereby freed for linear displacement with limited or no interference by the actuator coupling element 214. As a result, the actuator coupling element 214 is fully disengaged from the mandrel coupling collet 234 and the actuator assembly 208 is decoupled from the mandrel 222. It may also be observed that the unlatching projection 256 of the floating shifting member 230 now underlies the flexible latching member 240 of the releasable latching mechanism 238, which is thus fully unlatched from the floating shifting member 230.

Once the actuator coupling element 214 has been decoupled from the mandrel 222 as shown in FIG. 6, the mandrel 222 may be further displaced by the shifting tool 254 in an uphole direction to further or fully open the ICV 200 with limited or no resistance to movement by the electric actuator assembly 208. It may also be possible to partially or fully close the ICV 200 by moving the shifting tool 254 in the second direction. When the shifting tool 254 is disengaged from the floating shifting member 230 after placing the ICV 200 in a partially open or partially closed position, the selected position can be retained due to the friction of the seals 224 located between the mandrel 222 and the device body 202, the friction of the seals 232 between the floating shifting member 230 and the mandrel 222, and the friction of the seals 232 between the floating shifting member 230 and the device body 202.

It is shown in FIGS. 4-5 and described above relative thereto that the floating shifting member 230 can be displaced relative to the mandrel 222, and the electric actuator assembly 208 can be non-destructively decoupled from the mandrel 222, by an uphole movement of the shifting tool 254. At least in this example, a linear displacement of the floating shifting member 230 relative to the mandrel 222 and a non-destructive decoupling of the electric actuator assembly 208 from the mandrel 222 can also be accomplished by a downhole movement of the floating shifting member 230. In such a case, decoupling of the actuator coupling element 214 from the mandrel coupling collet 234 of the floating shifting member 230 occurs by linearly displacing the floating shifting member 230 in a downhole direction relative to the mandrel 222. This results in the collet support projection 236 and the unlatching projection 256 of the floating shifting member 230 moving in an opposite direction to that shown in FIGS. 5-6. Specifically, rather than the collet support projection 236 moving to a position uphole of the mandrel coupling collet 234 and the unlatching projection 256 moving to a position under the flexible latching member 240 as shown in FIG. 6, a downhole movement of the shifting tool 254 will cause the collet support projection 236 to move to a position downhole of the mandrel coupling collet 234 and the unlatching projection 256 to move to a position downhole of the flexible latching member 240. As a result, the mandrel coupling collet 234 may be deflected inward toward the central axis CA and into a relief area 237 (see FIG. 6) of the floating shifting member 230 that is uphole of the collet support projection 236. The inward deflection of the mandrel coupling collet 234 may again be caused by contact between the inwardly projecting lobe 214*b* of the actuator coupling element 214 and the protruding engagement surface 234*a* of the mandrel coupling collet 234. Likewise, the flexible latching member 240 can be unlatched from the floating shifting member 230 by the downhole movement of the shifting tool 254. In this example, the flexible latching member 240 can be unlatched by contact with a portion of the outer wall surface of the floating shifting member 230 that resides uphole of the latching groove 244 as the floating shifting member 230 is displaced in a downhole direction relative to the mandrel 222.

Figure 7:
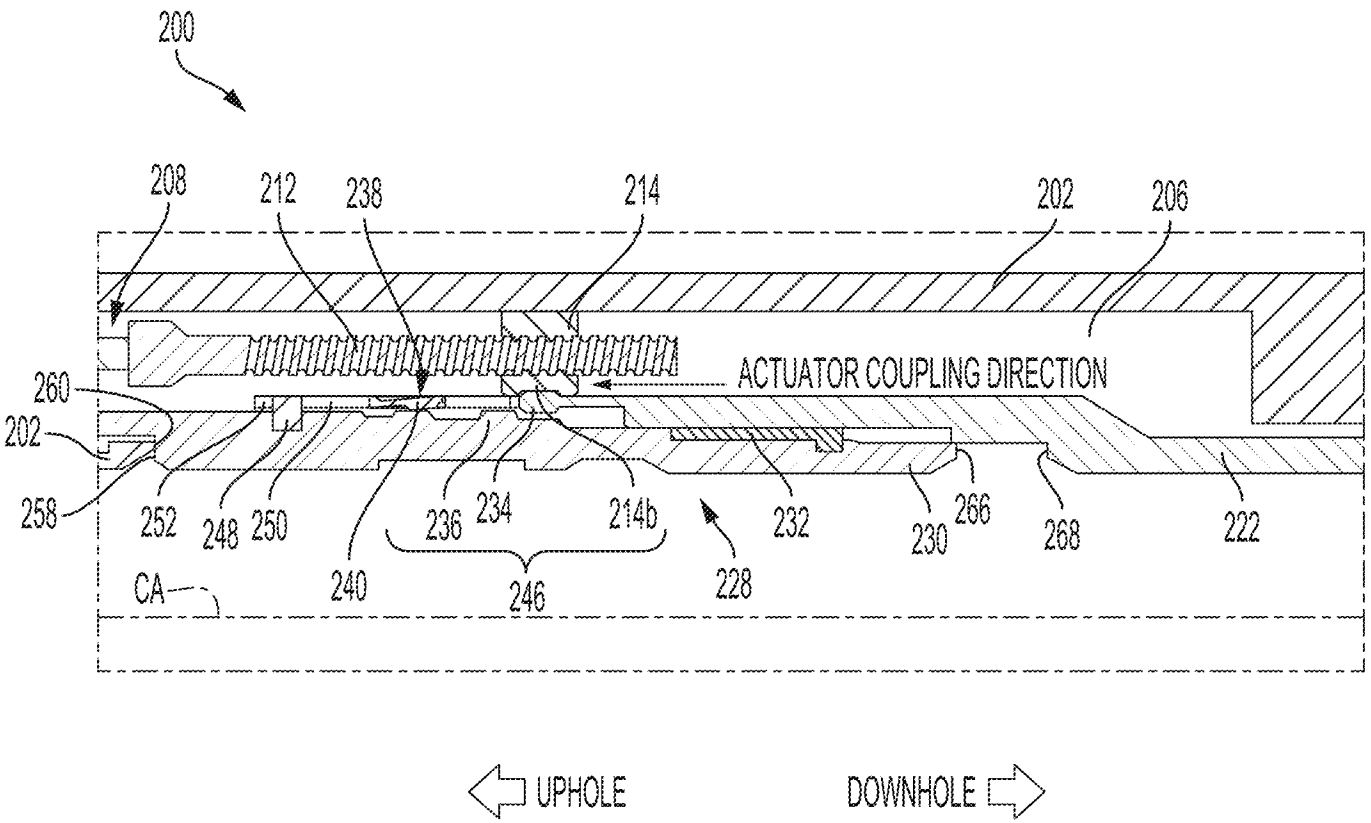
FIG. 7 depicts the enlarged cross-sectional view of FIG. 6, but with the actuator assembly recoupled to the flow control component as a result of further operation of the actuator assembly.

FIG. 7 depicts the portion of the ICV 200 shown in FIG. 6, but with the actuator coupling element 214 and the mandrel coupling collet 234 reengaged. Assuming that the electric actuator assembly 208 is still functional after being decoupled from the mandrel 222 and after use of the shifting tool 254 to manually displace the mandrel 222, it may be possible to recouple the mandrel 222 to the actuator coupling element 214 so that fluid flow through the ICV 200 may again be electronically controlled by operating the drive motor 210 of the electric actuator assembly 208. As shown in FIG. 7, the actuator coupling element 214 may be displaced by operating the drive motor 210 until the actuator coupling element 214 becomes aligned with the mandrel coupling collet 234 and the protruding engagement surface 234*a* of the mandrel coupling collet 234 reenters the retention recess 214*a* in the actuator coupling element 214. As shown, the collet support projection 236 of the floating shifting member 230 does not underly the mandrel coupling collet 234 after the mandrel 222 and the floating shifting member 230 have been linearly displaced to such positions by the shifting tool 254. The mandrel coupling collet 234 may thus be deflected temporarily downward by the leading projecting lobe 214*b* of the actuator coupling element 214 as the actuator coupling element 214 passes over the mandrel coupling collet 234 during the reengagement operation.

Figure 8:
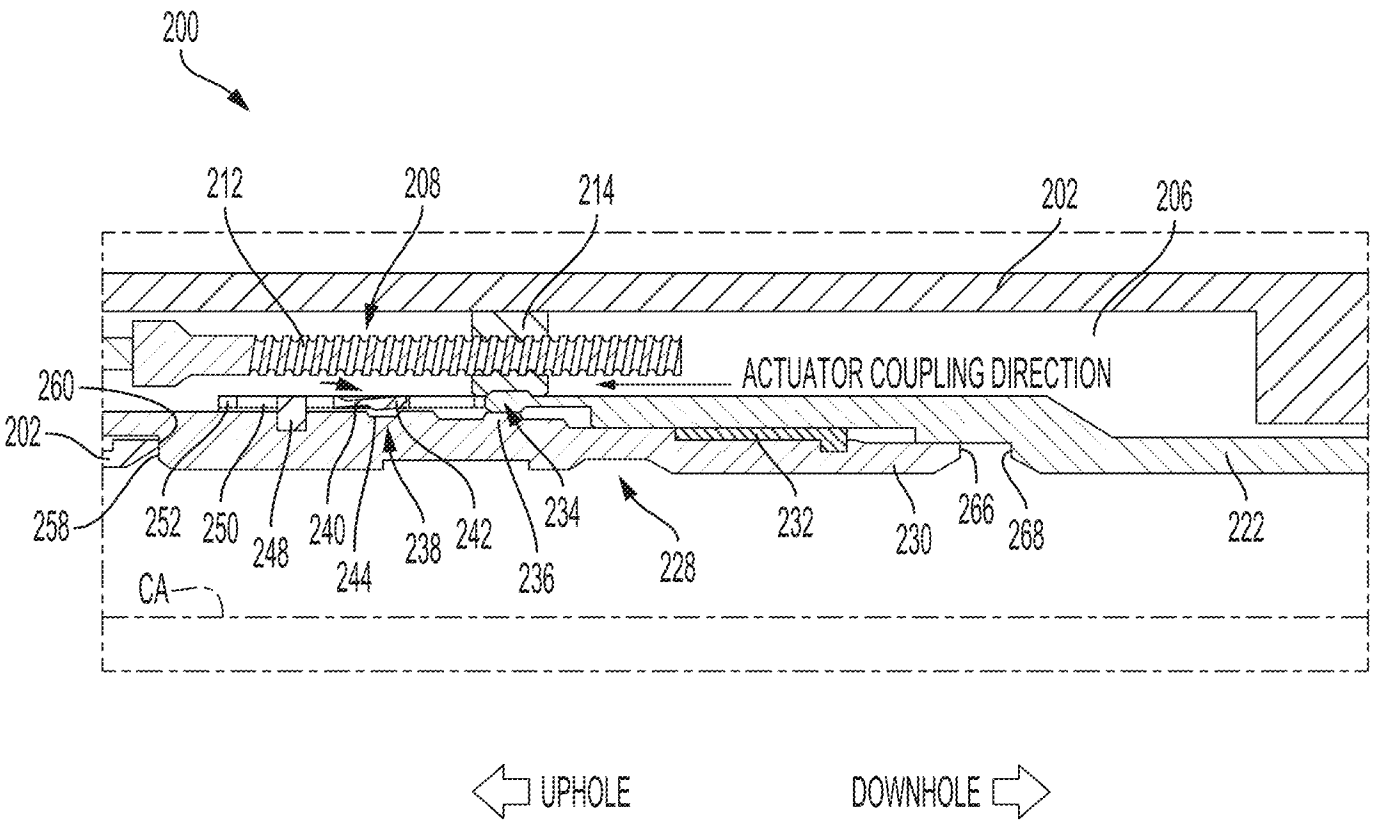
FIG. 8 depicts the enlarged cross-sectional view of FIG. 7, with additional realignment of the flow control component and various components of the override assembly as a result of further operation of the actuator assembly.

FIG. 8 depicts the portion of the ICV 200 shown in FIG. 7, but with the actuator coupling element 214 displaced further uphole by additional operation of the drive motor 210 and corresponding rotation of the lead screw/ball screw 212. As shown, the additional linear displacement of the actuator coupling element 214 also causes a like linear displacement of the mandrel 222 due to the reengaged arrangement of the actuator coupling element 214 and the mandrel coupling collet 234. In the position shown in FIG. 8, the floating shifting member 230 is prevented from further up hole movement by contact between the stop face 258 of the floating shifting member 230 and the stop face 260 of the device body 202. The mandrel 222 can thus be linearly displaced by the electric actuator assembly 208 relative to the floating shifting member 230 until the mandrel 222 and the floating shifting member 230 are placed in the relative positions shown in FIG. 8. With the mandrel 222 and the floating shifting member 230 so positioned, the collet support projection 236 once again supports retention of the mandrel coupling collet 234 by the actuator coupling element 214. Likewise, the flexible latching member 240 of the releasable latching mechanism 238 may also reengage the latching groove 244 located in the outer wall surface of the floating shifting member 230, as indicated by the arrow. The lead screw/ball screw 212 may then be rotated in the opposite direction by the drive motor 210 to displace the actuator coupling element 214 and return the mandrel 222 and the coupled floating shifting member 230 to the position within the device body 202 shown in FIG. 3.

Figure 9:
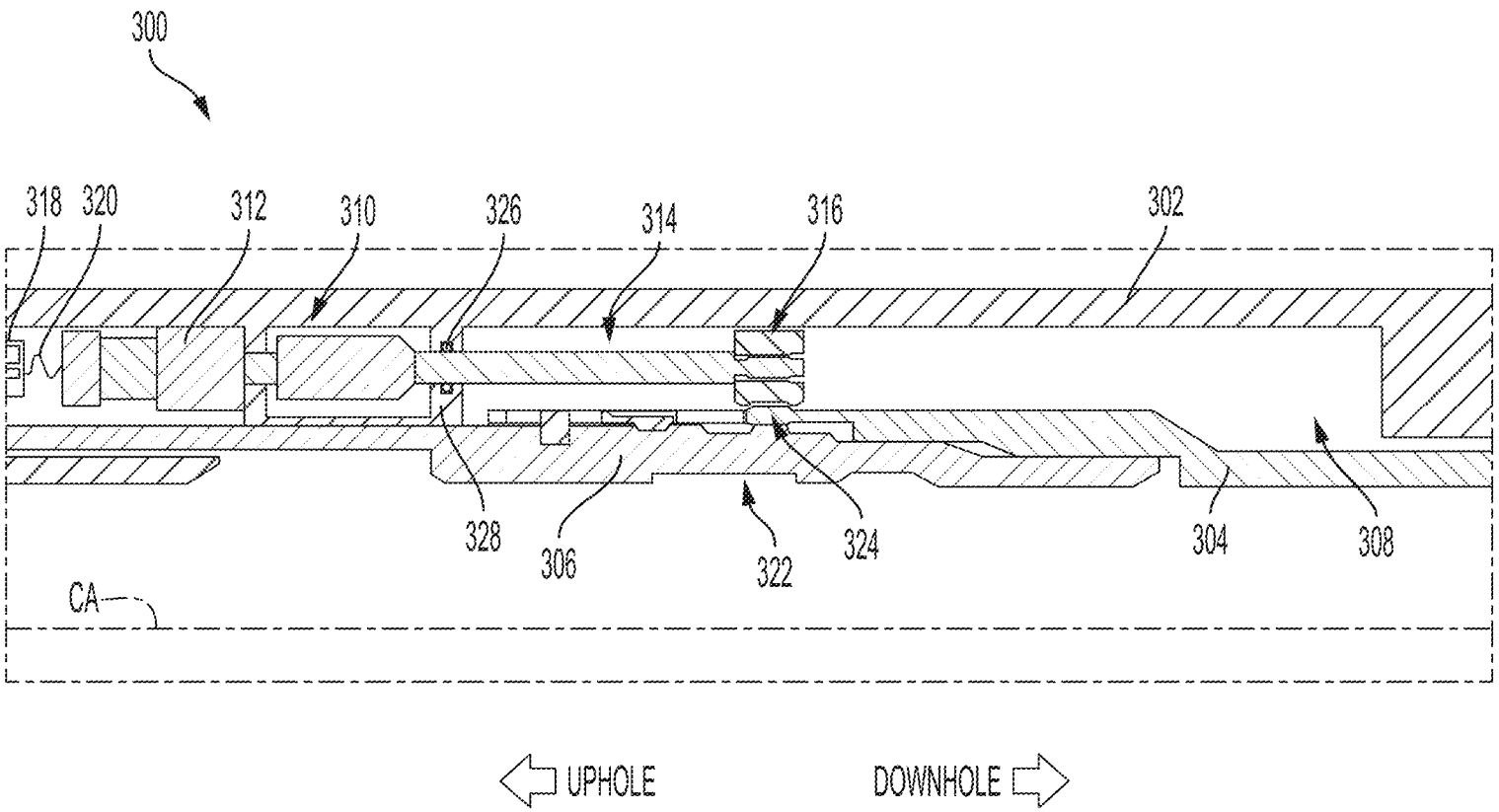
FIG. 9 depicts a cross-sectional side view of another flow control device configured as an inflow control valve for controlling a downhole flow of hydrocarbons into completion tubing deployed in a wellbore and including an override assembly, according to another example.

FIG. 9 presents a cross-sectional side view of one half of another flow control device configured as an electronic inflow control valve (ICV) 300 that is deployable downhole in a wellbore. The ICV 300 may serve, for example, as the ICV 120 of the hydrocarbon well 100 illustrated in FIG. 1 to control a downhole flow of hydrocarbons into the tubing string 112 located in the wellbore 102.

The ICV 300 may be identical in construction and operation to the ICV 200 of FIGS. 2-8, but with a different seal configuration. As such, the ICV 300 may be observed to include a device body 302, a mandrel 304, and a floating shifting member 306. Each of the device body 302, the mandrel 304, and the floating shifting member 306 may be a substantially hollow tubular member and may be assembled to one another with the same concentric arrangement described above relative to the ICV 200 of FIGS. 2-8.

The device body 302 may again include a cavity 308. Located within the cavity 308 may be an electric actuator assembly 310 comprising an drive motor 312 that rotates a lead screw/ball screw 314 to linearly displace a linearly displaceable nut configured as an actuator coupling element 316. Control hardware such as a printed circuit board 318 may be coupled by wiring 320 to the drive motor 312 for controlling operation of the drive motor 312.

The ICV 300 may further include an override assembly 322 that includes the floating shifting member 306, a mandrel coupling collet 324, and each of the various other elements described with respect to the ICV 200 of FIGS. 2-8 that can allow the mandrel 304 and the floating shifting member 306 to be releasably coupled and linearly displaced as a unit, and for the electric actuator assembly 310 to be non-destructively decoupled from the mandrel 304 by a linear displacement force applied to the floating shifting member 306 by a shifting tool.

Unlike the ICV 200 of FIGS. 2-8, no seals are interposed between the mandrel 304 and the device body 302, between the mandrel 304 and the floating shifting member 306, nor between the floating shifting member 306 and device body 302 of the ICV 300 of FIG. 9. Instead, the ICV 300 relies on only a seal 326 that is located in a portion 328 of the device body 302 through which the lead screw/ball screw 314 passes. Aside from the different seal configuration, the construction and various operations of the ICV 300 may be the same as in the ICV 200 of FIGS. 2-8.

Figure 10:
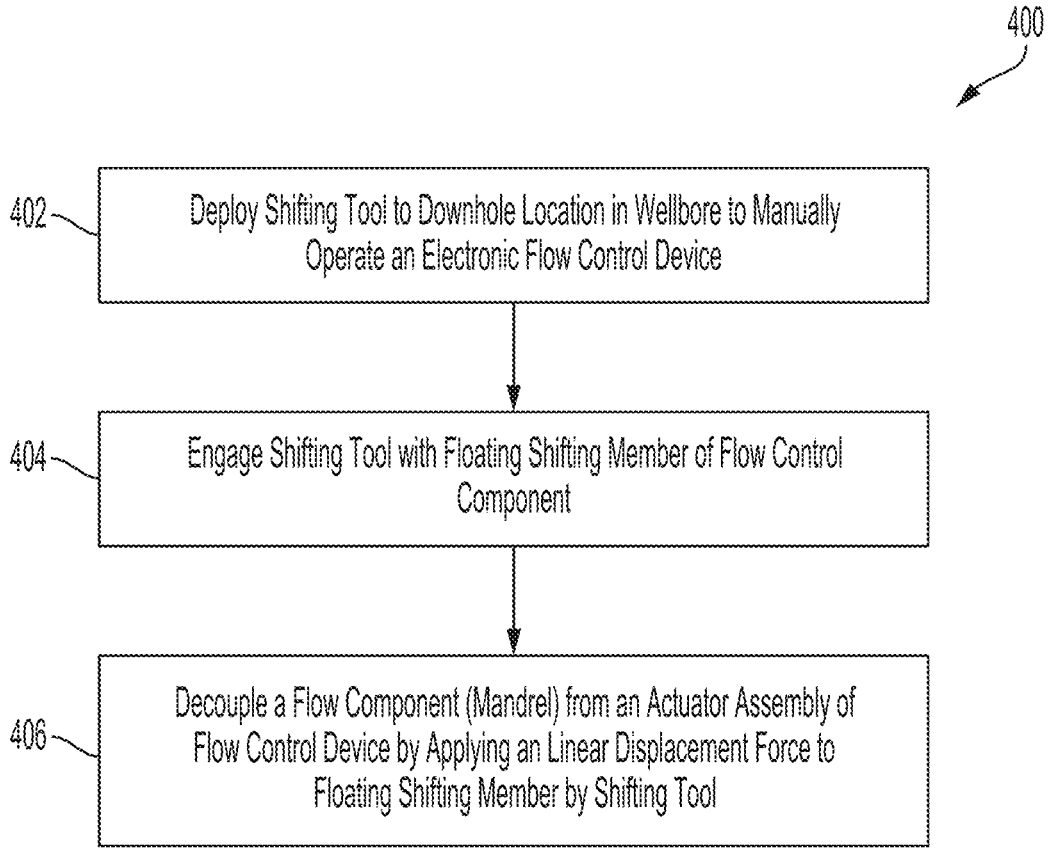
FIG. 10 depicts a flow chart of a method of non-destructively decoupling an actuator from a flow control component of a flow control device used to control a downhole flow of hydrocarbons into completion tubing deployed in a wellbore, according to one example.

FIG. 10 is a flowchart 400 of a method of non-destructively decoupling an actuator from a flow control component of an electronic flow control device used to control a downhole flow of hydrocarbons into completion tubing deployed in a wellbore, according to one example. The method may be practiced, for example, using the ICV 200 or the ICV 300 described herein.

It can be observed from FIG. 10 at block 402, that a shifting tool is deployed to a downhole location in a wellbore of a hydrocarbon well to manually operate the electronic flow control device. The flow control device may include a device body. The flow control component may a mandrel, which can be concentrically arranged within the device body and may be linearly displaceable relative thereto. An actuator assembly may reside within the device body and can be operated to linearly displace the mandrel relative to the device body. The actuator assembly can include a linearly displaceable actuator coupling element. The flow control device may also include an override assembly. The override assembly may include a floating shifting member, which can be concentrically arranged within the mandrel and may be limitedly linearly displaceable relative thereto. The override assembly can also include a flexible mandrel coupling collet that s associated with the mandrel and is deflectable in a radially outward or radially inward direction to respectively engage with or disengage from the actuator coupling element of the actuator assembly.

At block 404, the shifting tool is engaged with the floating shifting member of the flow control component. The floating shifting member may include a shifting tool engagement profile that facilitates engagement of the floating shifting member by the shifting tool.

At block 406, the mandrel can be non-destructively decoupled from the actuator assembly by applying a linear displacement force in a first direction to the floating shifting member by the shifting tool. The linear displacement force causes the floating shifting member to be linearly displaced from a first position where the floating shifting member maintains a coupled relationship of the flow control component coupling collet and the actuator coupling element to a second position where the flow control component coupling collet is unsupported by the floating shifting member and the flow control component coupling collet and the actuator coupling element are decoupled by an inward deflection of the flow control component coupling collet. The shifting tool may thereafter be used to adjust the position of the flow control component relative to the device body without resistance from the actuator assembly. For example, the shifting tool can be used to fully open or fully close the flow control device, or to otherwise adjust a flow rate through the flow control device.

For purposes of illustration, a flow control device has been described and shown herein as one particular type of an inflow control valve is a valve. It is to be understood, however, that a valve according to the present disclosure can instead be a ball valve, a safety valve, a flapper valve, or another type of valve where an actuator is used to displace a flow control element. For example, instead of linearly displacing a sleeve-like flow control element, an actuator might displace a ball of a ball valve, rotate a flapper of a flapper valve, or open a poppet of a poppet valve. In examples where a valve according to the present disclosure incorporates a flow control component other than a linearly displaceable flow control component (e.g., mandrel) as shown and described herein, operation of the flow control component may, instead of opening or closing ports in the valve, open or close a tubing string to which the valve is installed.

According to aspects of the present disclosure, a flow control device, an override assembly for a flow control device, and a method, are provided according to one or more of the following examples. As used below, any reference to a series of examples is to be understood as a reference to each of those examples disjunctively (e.g., "Examples 1-4" is to be understood as "Examples 1, 2, 3, or 4").

Example 1 is a downhole flow control device deployable in a wellbore comprising: a device body; a flow control component concentrically arranged within the device body and linearly displaceable relative thereto to selectively control a flow of fluid from the wellbore; an actuator assembly residing within a cavity in the device body and couplable to the flow control component to linearly displace the flow control component relative to the device body; and an override assembly including a floating shifting member concentrically arranged within the flow control component and engageable by a downhole deployable shifting tool, the floating shifting member limitedly linearly displaceable relative to the flow control component from a first position where the floating shifting member supports a coupled arrangement of the flow control component and the actuator assembly to a second position where the coupled arrangement of the flow control component and the actuator assembly is unsupported by the floating shifting member and the flow control component is decouplable from the actuator assembly.

Example 2 is the downhole flow control device of example 1, wherein the actuator assembly is a linear actuator assembly comprising: an electric drive motor and a linear displacement element that is coupled to and rotatable by the electric drive motor; and an actuator coupling element in threaded engagement with the linear displacement element, the actuator coupling element rotationally constrained but linearly displaceable within the cavity.

Example 3 is the downhole flow control device of example 2, wherein the override assembly further includes a flow control component coupling element that resides between the linear actuator assembly and the floating shifting member and is releasably engageable with the actuator coupling element to releasably couple the drive motor and the linear displacement element to the flow control component.

Example 4 is the downhole flow control device of example 1, wherein the flow control component coupling element is associated with the flow control component and comprises a flexible member that is deflectable in a radially outward or radially inward direction to respectively engage with or disengage from the actuator coupling element.

Example 5 is the downhole flow control device of example 4, wherein the flow control component coupling element includes a protruding engagement surface and the actuator coupling element includes a corresponding retention recess within which the protruding mating surface may be releasably retained to releasably couple the actuator assembly to the flow control component.

Example 6 is the downhole flow control device of example 1, wherein the floating shifting member includes a shifting tool engagement profile on an inner wall surface thereof to engage a shifting tool.

Example 7 is the downhole flow control device of example 1, wherein the floating shifting member includes an actuator coupling-decoupling profile on an outer wall surface thereof, the actuator coupling-decoupling profile comprising: a flow control component coupling element support projection extending radially outwardly from the floating shifting member to support engagement of the flow control component coupling element with the actuator coupling element when the floating shifting member and the flow control component are positioned relative to one another such that the flow control component coupling element support projection underlies the flow control component coupling element.

Example 8 is the downhole flow control device of example 1, wherein the override assembly further includes a releasable latching mechanism to releasably couple the flow control component to the floating shifting member, the releasable latching mechanism comprising: a flexible latching member associated with the flow control component and including a protruding engagement portion; and a latching groove located in an outer wall surface of the floating shifting member to receive the protruding engagement portion of the flexible latching member when the floating shifting member and the flow control component are positioned relative to one another such that the latching groove is aligned with the protruding engagement portion of the flexible latching member.

Example 9 is the downhole flow control device of example 1, wherein the floating shifting member is further releasably coupled to the flow control component by a friction of at least one seal interposed between the floating shifting member and the flow control component.

Example 10 is the downhole flow control device of example 1, wherein: a stop element extends radially outward from an outer surface of the floating shifting member into a receiving slot in the flow control component; the stop element is contactable with a hard stop in the receiving slot during linear displacement of the floating shifting member relative to the flow control component; and further linear displacement of the floating shifting member is thereby conveyed to the flow control component.

Example 11 is an override assembly for decoupling an actuator from a displaceable flow control component of a flow control device, comprising: a flexible flow control component coupling element associated with the flow control component, the flexible flow control component coupling element engageable with an overlying actuator coupling element of the actuator to releasably couple the flow control component to the actuator; and a floating shifting member arranged within the flow control component and engageable by a downhole deployable shifting tool, the floating shifting member limitedly linearly displaceable relative to the flow control component from a first position where the floating shifting member supports a coupled arrangement of the flow control component coupling element and the actuator coupling element to a second position where the flow control component coupling element is unsupported by the floating shifting member and the flow control component coupling element and the actuator coupling element are decouplable.

Example 12 is the override assembly of example 11, wherein the flow control component coupling element is a flexible member that is deflectable in a radially outward or radially inward direction to respectively engage with or disengage from the actuator coupling element.

Example 13 is the override assembly of example 12, wherein the flow control component coupling element includes a protruding engagement surface and the actuator coupling element includes a corresponding retention recess within which the protruding mating surface may be releasably retained to releasably couple the actuator to the flow control component.

Example 14 is the override assembly of example 11, wherein the floating shifting member includes: a shifting tool engagement profile on an inner wall surface thereof to engage the shifting tool; and an actuator coupling-decoupling profile on an outer wall surface thereof, the actuator coupling-decoupling profile comprising: a flow control component coupling element support projection extending radially outwardly from the floating shifting member to support engagement of the flow control component coupling element with the actuator coupling element when the floating shifting member and the flow control component are positioned relative to one another such that the flow control component coupling element support projection underlies the flow control component coupling element.

Example 15 is the override assembly of example 11, wherein the override assembly further includes a releasable latching mechanism to releasably couple the flow control component to the floating shifting member, the releasable latching mechanism comprising: a flexible latching member associated with the flow control component and including a protruding engagement portion; and a latching groove located in an outer wall surface of the floating shifting member to receive the protruding engagement portion of the flexible latching member when the floating shifting member and the flow control component are positioned relative to one another such that the latching groove is aligned with the protruding engagement portion of the flexible latching member.

Example 16 is a method comprising: deploying a shifting tool to a downhole location in a wellbore of a hydrocarbon well to manually operate an electronic flow control device, the electronic flow control device further comprising: a device body, a flow control component concentrically arranged within the device body and linearly displaceable relative thereto, an actuator assembly residing within the device body and operated to linearly displace the flow control component relative to the device body, the actuator assembly including a linearly displaceable actuator coupling element, and an override assembly including a floating shifting member concentrically arranged within the flow control component and limitedly linearly displaceable relative thereto, and a flexible flow control component coupling element associated with the flow control component and deflectable in a radially outward or radially inward direction to respectively engage with or disengage from the actuator coupling element of the actuator assembly, engaging the shifting tool with the floating shifting member of the flow control component; and decoupling the flow control component from the actuator assembly by applying a linear displacement force to the floating shifting member by the shifting tool in one of a first direction or a second direction that causes the floating shifting member to be linearly displaced from a first position where the floating shifting member maintains a coupled relationship of the flow control component coupling element and the actuator coupling element, to a second position where the flow control component coupling element is unsupported by the floating shifting member and the flow control component coupling element and the actuator coupling element are decoupled by an inward deflection of the flow control component coupling element.

Example 17 is the method of example 16, wherein: in the first position of the floating shifting member, a flow control component coupling element support projection extending radially outwardly from the floating shifting member underlies the flow control component coupling element; in the second position of the floating shifting member, the flow control component coupling element support projection no longer underlies the flow control component coupling element; and the flow control component coupling element is deflected inward by an inwardly projecting lobe of the actuator coupling element.

Example 18 is the method of example 17, further comprising: subsequent to decoupling the flow control component from the actuator assembly, recoupling the flow control component to the actuator assembly by linearly displacing the actuator coupling element by the actuator assembly until the actuator coupling element overlies and becomes reengaged with the flow control component coupling element; and subsequent to the actuator coupling element becoming reengaged with the flow control component coupling element, operating the actuator assembly to linearly displace the flow control component relative to the floating shifting member until the flow control component coupling element support projection of the floating shifting member underlies the flow control component coupling element.

Example 19 is the method of example 16, further comprising releasably coupling the flow control component to the floating shifting member via a flexible latching member associated with the flow control component by linearly displacing the floating shifting member relative to the flow control component using the actuator assembly until a protruding engagement portion of the flexible latching member is received in a corresponding latching groove located in an outer wall surface of the floating shifting member.

Example 20 is the method of example 16, wherein, subsequent to decoupling the flow control component from the actuator assembly, the shifting tool is used to adjust a fluid flow parameter of the flow control device.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A downhole flow control device deployable in a wellbore comprising: a device body; a flow control component concentrically arranged within the device body and linearly displaceable relative thereto to selectively control a flow of fluid from the wellbore; an actuator assembly residing within a cavity in the device body and couplable to the flow control component to linearly displace the flow control component relative to the device body; and an override assembly including a floating shifting member concentrically arranged within the flow control component and engageable by a downhole deployable shifting tool, the floating shifting member limitedly linearly displaceable relative to the flow control component from a first position where the floating shifting member supports a coupled arrangement of the flow control component and the actuator assembly to a second position where the coupled arrangement of the flow control component and the actuator assembly is unsupported by the floating shifting member and the flow control component is resultantly non-destructively decouplable from the actuator assembly such that the actuator assembly is capable of recoupling to the flow control component to resume operating the flow control component.

2. The downhole flow control device of claim 1, wherein the actuator assembly is a linear actuator assembly comprising:

an electric drive motor and a linear displacement element that is coupled to and rotatable by the electric drive motor; and an actuator coupling element in threaded engagement with the linear displacement element, the actuator coupling element rotationally constrained but linearly displaceable within the cavity.

3. The downhole flow control device of claim 2, wherein the override assembly further includes a flow control component coupling element that resides between the linear actuator assembly and the floating shifting member and is releasably engageable with the actuator coupling element to releasably couple the drive motor and the linear displacement element to the flow control component.

4. The downhole flow control device of claim 3, wherein the flow control component coupling element is associated with the flow control component and comprises a flexible member that is deflectable in a radially outward or radially inward direction to respectively engage with or disengage from the actuator coupling element.

5. The downhole flow control device of claim 4, wherein the flow control component coupling element includes a protruding engagement surface and the actuator coupling element includes a corresponding retention recess within which the protruding engagement surface may be releasably retained to releasably couple the actuator assembly to the flow control component.

6. The downhole flow control device of claim 1, wherein the floating shifting member includes a shifting tool engagement profile on an inner wall surface thereof to engage a shifting tool.

7. The downhole flow control device of claim 1, wherein the floating shifting member includes an actuator coupling-decoupling profile on an outer wall surface thereof, the actuator coupling-decoupling profile comprising:

a flow control component coupling element support projection extending radially outwardly from the floating shifting member to support engagement of a flow control component coupling element that resides between the actuator assembly and the floating shifting member with an actuator coupling element associated with the actuator assembly when the floating shifting member and the flow control component are positioned relative to one another such that the flow control component coupling element support projection underlies the flow control component coupling element.

8. The downhole flow control device of claim 1, wherein the override assembly further includes a releasable latching mechanism to releasably couple the flow control component to the floating shifting member, the releasable latching mechanism comprising:

a flexible latching member associated with the flow control component and including a protruding engagement portion; and a latching groove located in an outer wall surface of the floating shifting member to receive the protruding engagement portion of the flexible latching member when the floating shifting member and the flow control component are positioned relative to one another such that the latching groove is aligned with the protruding engagement portion of the flexible latching member.

9. The downhole flow control device of claim 1, wherein the floating shifting member is further releasably coupled to the flow control component by a friction of at least one seal interposed between the floating shifting member and the flow control component.

10. The downhole flow control device of claim 1, wherein:

a stop element extends radially outward from an outer surface of the floating shifting member into a receiving slot in the flow control component;

the stop element is contactable with a hard stop in the receiving slot during linear displacement of the floating shifting member relative to the flow control component; and further linear displacement of the floating shifting member is thereby conveyed to the flow control component.

11. An override assembly for non-destructively decoupling an actuator from a displaceable flow control component of a flow control device, comprising: a flexible flow control component coupling element associated with the flow control component, the flexible flow control component coupling element engageable with an overlying actuator coupling element of the actuator to releasably couple the flow control component to the actuator; and a floating shifting member arranged within the flow control component and engageable by a downhole deployable shifting tool, the floating shifting member limitedly linearly displaceable relative to the flow control component from a first position where the floating shifting member supports a coupled arrangement of the flow control component coupling element and the actuator coupling element to a second position where the flow control component coupling element is unsupported by the floating shifting member and the flow control component coupling element and the actuator coupling element are resultantly non-destructively decouplable such that the actuator is capable of recoupling to the flow control component to resume operating the flow control component.

12. The override assembly of claim 11, wherein the flow control component coupling element is a flexible member that is deflectable in a radially outward or radially inward direction to respectively engage with or disengage from the actuator coupling element.

13. The override assembly of claim 12, wherein the flow control component coupling element includes a protruding engagement surface and the actuator coupling element includes a corresponding retention recess within which the protruding mating surface may be releasably retained to releasably couple the actuator to the flow control component.

14. The override assembly of claim 11, wherein the floating shifting member includes:

a shifting tool engagement profile on an inner wall surface thereof to engage the shifting tool; and an actuator coupling-decoupling profile on an outer wall surface thereof, the actuator coupling-decoupling profile comprising:

a flow control component coupling element support projection extending radially outwardly from the floating shifting member to support engagement of the flow control component coupling element with the actuator coupling element when the floating shifting member and the flow control component are positioned relative to one another such that the flow control component coupling element support projection underlies the flow control component coupling element.

15. The override assembly of claim 11, wherein the override assembly further includes a releasable latching mechanism to releasably couple the flow control component to the floating shifting member, the releasable latching mechanism comprising:

a flexible latching member associated with the flow control component and including a protruding engagement portion; and a latching groove located in an outer wall surface of the floating shifting member to receive the protruding engagement portion of the flexible latching member when the floating shifting member and the flow control component are positioned relative to one another such that the latching groove is aligned with the protruding engagement portion of the flexible latching member.

16. A method comprising: deploying a shifting tool to a downhole location in a wellbore of a hydrocarbon well to manually operate an electronic flow control device, the electronic flow control device further comprising: a device body, a flow control component concentrically arranged within the device body and linearly displaceable relative thereto, an actuator assembly residing within the device body and operated to linearly displace the flow control component relative to the device body, the actuator assembly including a linearly displaceable actuator coupling element, and an override assembly including a floating shifting member concentrically arranged within the flow control component and limitedly linearly displaceable relative thereto, and a flexible flow control component coupling element associated with the flow control component and non-permanently deflectable in a radially outward or radially inward direction to respectively engage with or disengage from the actuator coupling element of the actuator assembly, engaging the shifting tool with the floating shifting member of the flow control component; and non-destructively decoupling the flow control component from the actuator assembly by applying a linear displacement force to the floating shifting member by the shifting tool in one of a first direction or a second direction that causes the floating shifting member to be linearly displaced from a first position where the floating shifting member maintains a coupled relationship of the flow control component coupling element and the actuator coupling element, to a second position where the flow control component coupling element is unsupported by the floating shifting member and the flow control component coupling element and the actuator coupling element are resultantly non-destructively decoupled by an inward deflection of the flow control component coupling element such that the actuator assembly is capable of recoupling to the flow control component to resume operating the flow control component.

17. The method of claim 16, wherein:

in the first position of the floating shifting member, a flow control component coupling element support projection extending radially outwardly from the floating shifting member underlies the flow control component coupling element;

in the second position of the floating shifting member, the flow control component coupling element support projection no longer underlies the flow control component coupling element; and the flow control component coupling element is deflected inward by an inwardly projecting lobe of the actuator coupling element.

18. The method of claim 17, further comprising:

subsequent to decoupling the flow control component from the actuator assembly, recoupling the flow control component to the actuator assembly by linearly displacing the actuator coupling element by the actuator assembly until the actuator coupling element overlies and becomes reengaged with the flow control component coupling element; and subsequent to the actuator coupling element becoming reengaged with the flow control component coupling element, operating the actuator assembly to linearly displace the flow control component relative to the floating shifting member until the flow control component coupling element support projection of the floating shifting member underlies the flow control component coupling element.

19. The method of claim 16, further comprising releasably coupling the flow control component to the floating shifting member via a flexible latching member associated with the flow control component by linearly displacing the floating shifting member relative to the flow control component using the actuator assembly until a protruding engagement portion of the flexible latching member is received in a corresponding latching groove located in an outer wall surface of the floating shifting member.

20. The method of claim 16, wherein, subsequent to decoupling the flow control component from the actuator assembly, the shifting tool is used to adjust a fluid flow parameter of the flow control device.

* * * * *